US006164289A

United States Patent [19]

Ogunro et al.

[11] Patent Number: 6,164,289

[45] Date of Patent: Dec. 26, 2000

[54] MECHANIZED HAIR BRAIDING APPARATUS

[75] Inventors: E. Olayinka Ogunro, 2727 Bolton Boone, Suite 105, DeSoto, Tex. 75115; Yiu Kwong Wan, Tsuen Wan, The Hong Kong Special Administrative Region of the People's Republic of China

[73] Assignee: E. Olayinka Ogunro, DeSoto, Tex.

[21] Appl. No.: 09/408,421

[22] Filed: Sep. 29, 1999

[51] Int. Cl.[7] ..... A45D 7/00; A45D 7/02; D04C 1/00

[52] U.S. Cl. ..... 132/210; 132/212; 87/8

[58] Field of Search ..... 132/210, 226, 132/245, 266, 237, 200, 212; 87/8, 13, 33, 62, 25

[56] References Cited

U.S. PATENT DOCUMENTS

| | | | |
|---|---|---|---|
| 4,038,996 | 8/1977 | Eronini et al. | 132/210 |
| 4,307,737 | 12/1981 | Shipman | 132/210 |
| 4,369,690 | 1/1983 | Sapkus | 87/33 |
| 4,580,585 | 4/1986 | Sapkus | 132/210 |
| 4,583,561 | 4/1986 | Larsson | 132/210 |
| 5,758,670 | 6/1998 | Ogunro | 132/210 |

*Primary Examiner*—Gene Mancene
*Assistant Examiner*—Robyn Kieu Doan
*Attorney, Agent, or Firm*—John A. Thomas

[57] ABSTRACT

A hair braiding apparatus is disclosed comprising a two arms for receiving hooks. The hooks hold a first and second strand of hair, respectively, in slideable engagement and can be retracted and extended by the operator. A third stand of hair is braided with the first and second strands as the arms and books are caused to automatically rotate cyclically and reverse their previous positions. The cyclic rotation carries the first and second strands with it and produces a braid as the operator moves the third strand upward and downward through the opening defined by the arms and the first and second strands. The apparatus may be powered by a DC motor.

19 Claims, 9 Drawing Sheets

MECHANIZED HAIR BRAIDING APPARATUS

CLAIM FOR PRIORITY

This application claims the benefit of the filing date of that certain provisional patent application disclosing the same invention, titled "Mechanized Hair Braiding Apparatus" and filed May 28, 1999 under application No. 60/136,443. Co-inventor Albert Wan named in that application is one and the same person as Yiu Kwong Wan, the co-inventor named in the present application.

BACKGROUND

This invention relates to hair braiding apparatus, and more particularly to mechanized hair braiding apparatus which braids natural hair and weaves artificial hair into braids of natural hair.

Hair braiding is an ancient art. Even today it is usually practiced by hand. Some modern hair styles rely on weaving small braids over the entire scalp and thus require considerable time and labor. The prior art discloses many inventions directed to mechanizing the task of braiding hair. Generally these are complex machines intended to completely mechanize the task of braiding. Such machines will be complicated to manufacture, and thus relatively expensive in the retail hair-care market. The present invention is intended to solve this problem by partially mechanizing the task of braiding hair. The present invention allows the human braider to work faster and more accurately than by hand, yet it is simple to manufacture and operate. It may be used to weave strands of artificial hair into natural hair. Further, the apparatus may be safely used by young children to braid hair, including doll hair. The present invention is an improvement over the invention of applicant E. Olayinka Ogunro described in U.S. Pat. No. 5,758,670, "Hair Braiding Apparatus and Method."

SUMMARY

We disclose an apparatus for braiding hair which, its preferred embodiment comprises a left arm; the left arm receiving a left hook for grasping a first strand of hair; the left hook having a detent in its proximal end; and, a right arm; the right arm receiving a right hook for grasping a second strand of hair; the right hook having a detent in its proximal end. The left and right arms each have a hair guide.

A means for retracting and extending the left and right hooks with respect to the left and right arms is provided, so that the left and right hooks hold the first and second strands of hair respectively, in slideable engagement. This means comprises a slideably operated means attached to the proximal end of each hook; a spring engaging the proximal end of each hook and urging the hooks to extend from the arms; an adjustable carriage, the carriage further comprising two latches; each latch selectively engaging a corresponding detent, thereby selectively locking either or both of the hooks in a selected retracted position. A screw passes through and threadably engages the carriage, whereby the position of the carriage may be adjusted by turning the screw.

The preferred embodiment has a means for releasing the hooks from a retracted position comprising a button contacting each latch, so as to selectively disengage one or both latches when the button is pressed; and, a means for automatically cyclically reversing the positions of the left and right arms, so that the first strand, the second strand, and a third strand of hair may be braided together by alternate reversal of the positions of the left and right arms while the third strand is alternately pulled upward and downward by the operator. This means comprises a battery-powered DC motor connected to a speed-reducing transmission; and, the speed-reducing transmission connected to a means for converting continuous rotary motion from the motor to cyclic rotary motion. The means for converting continuous rotary motion from the motor to cyclic rotary motion comprises an eccentrically rotating first pin; a link having a first end and a second end; the link fixed moveably at its first end by a pivot; a rack connected to the second end of the link; the rack engaging a pinion; the pinion connected to the left and right arms, so that the left and right arms rotate and cyclically reverse their positions as the pinion is turned by the rack.

DRAWINGS

Figure 7:
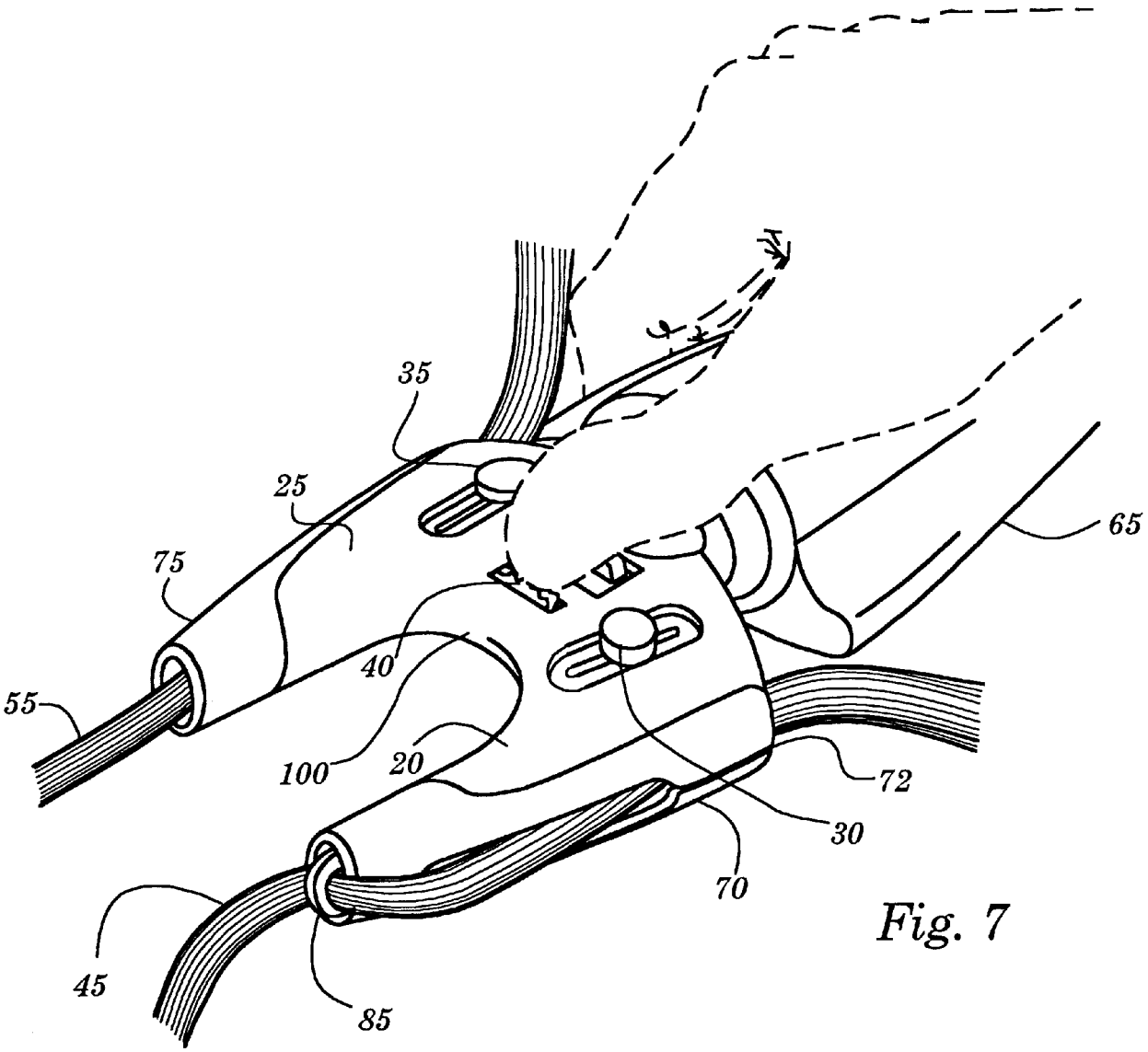

FIG. 7 a perspective view of the arms of the preferred embodiment, showing the one hook retracting and grasping a strand of hair.

Figure 8:
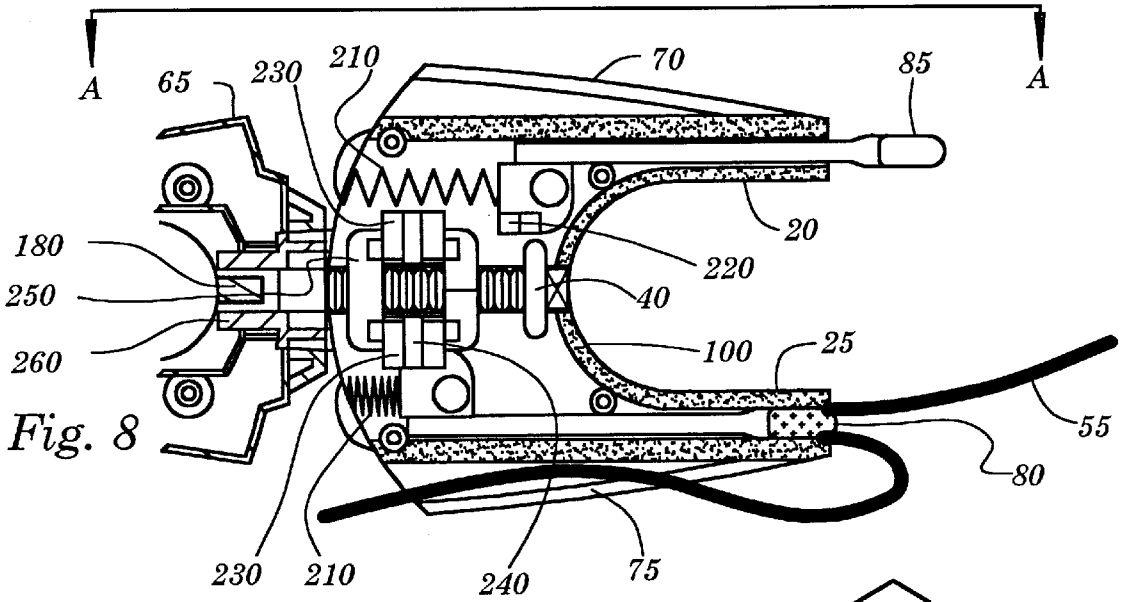

FIGS. 8 is a cross-sectional views of the arms of the preferred embodiment showing the means for retracting and extending the hooks into the arms.

Figure 9:
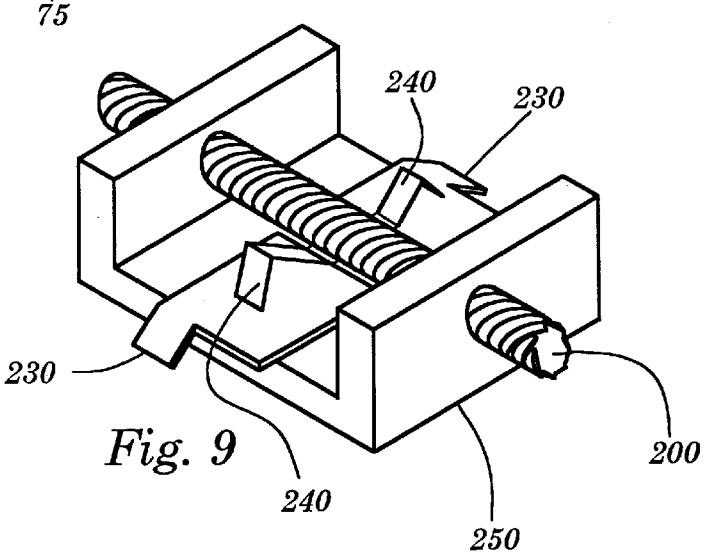

FIG. 9 is a perspective view of the carriage and means for locking and releasing the hooks.

Figure 10:
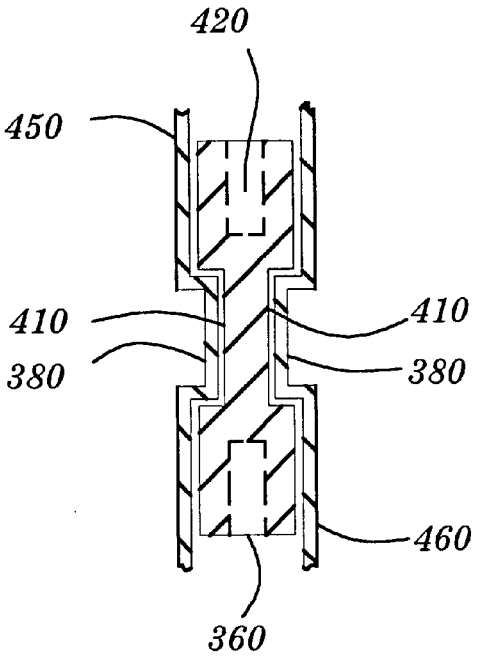
Figure 11:
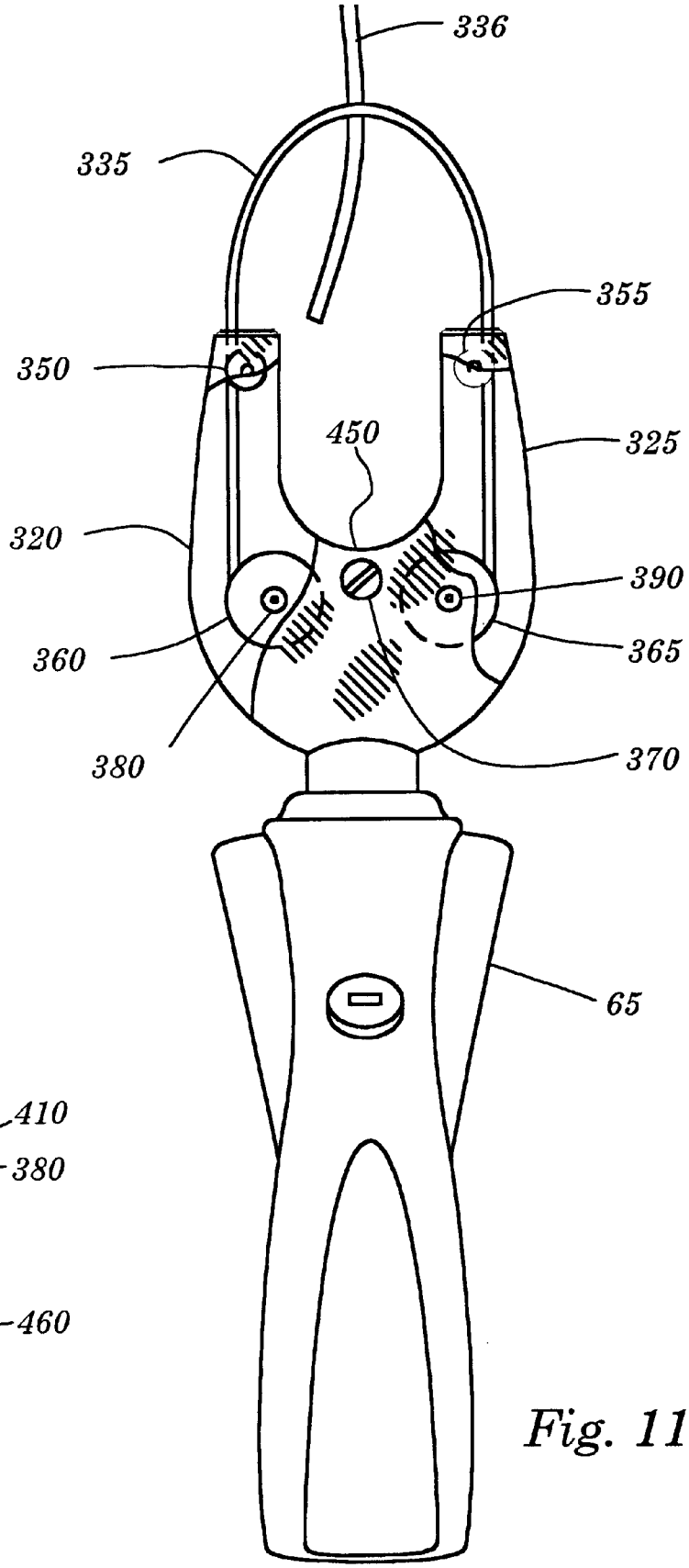

FIGS. 10 and 11 show another embodiment of the invention.

DETAILED DESCRIPTION

Figure 1:
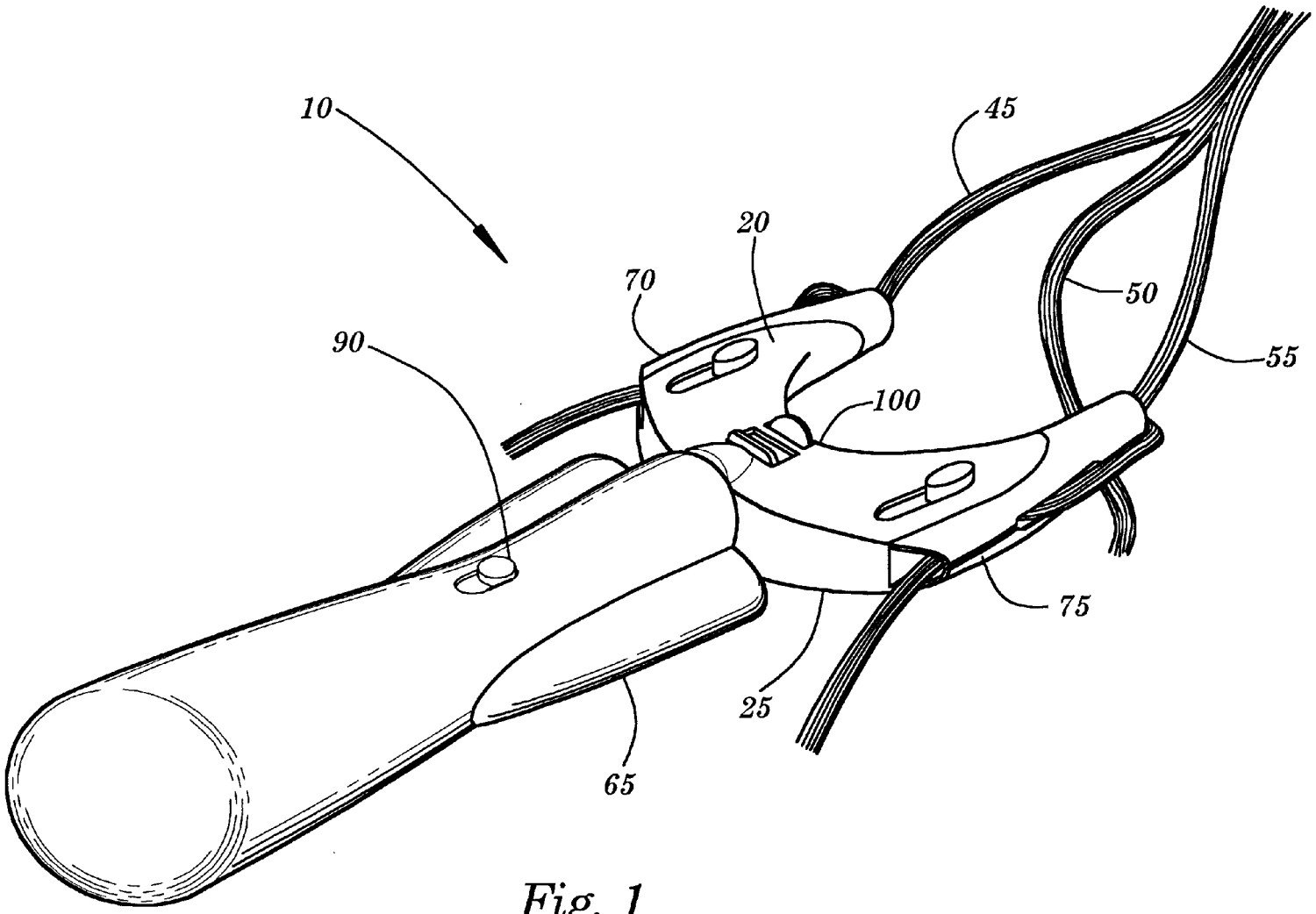
FIG. 1 shows the preferred embodiment in perspective view, positioned to begin a braid.
Figure 2:
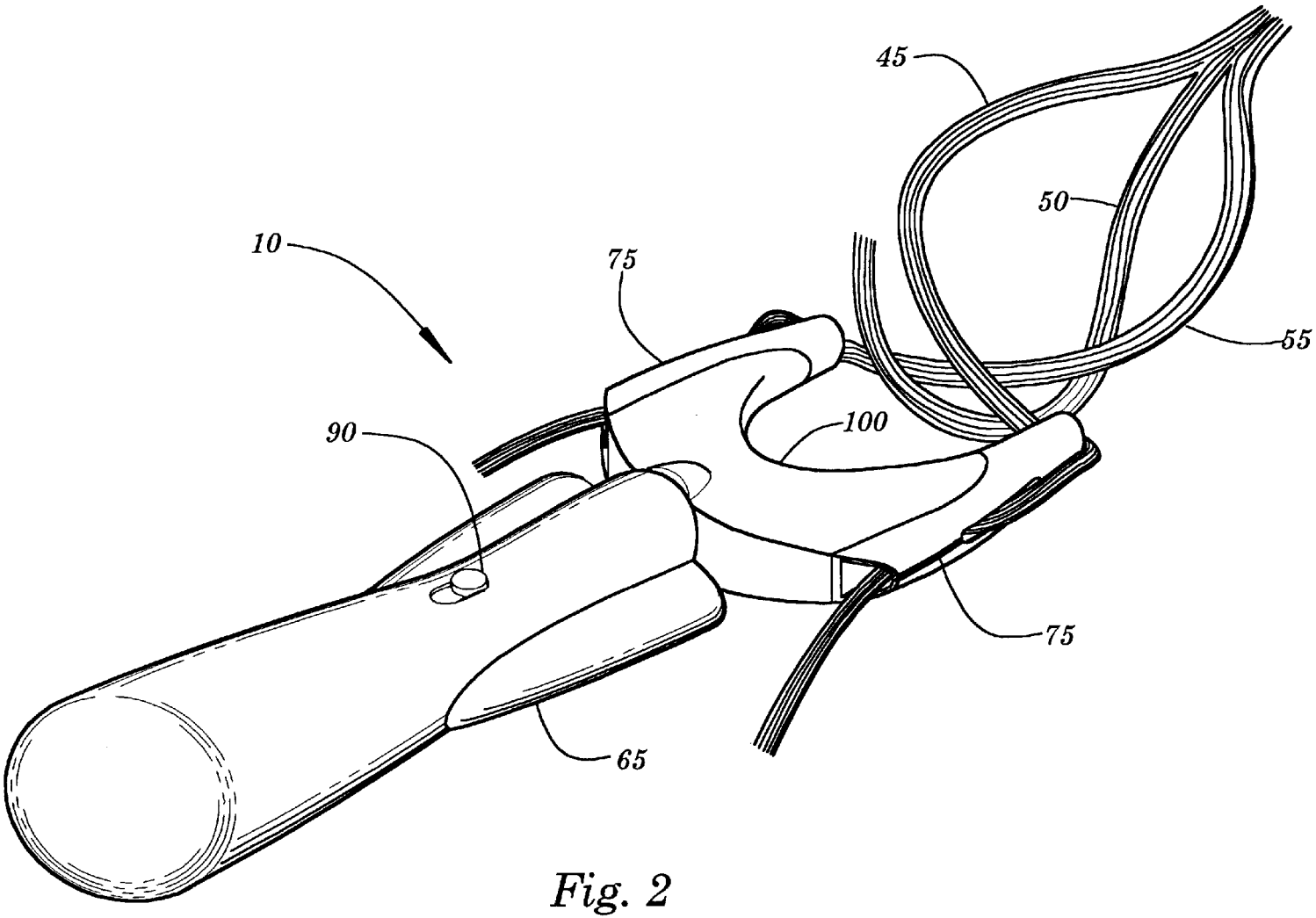
FIG. 2 shows the preferred embodiment in perspective, positioned in the second stage of a braiding cycle.
Figure 3:
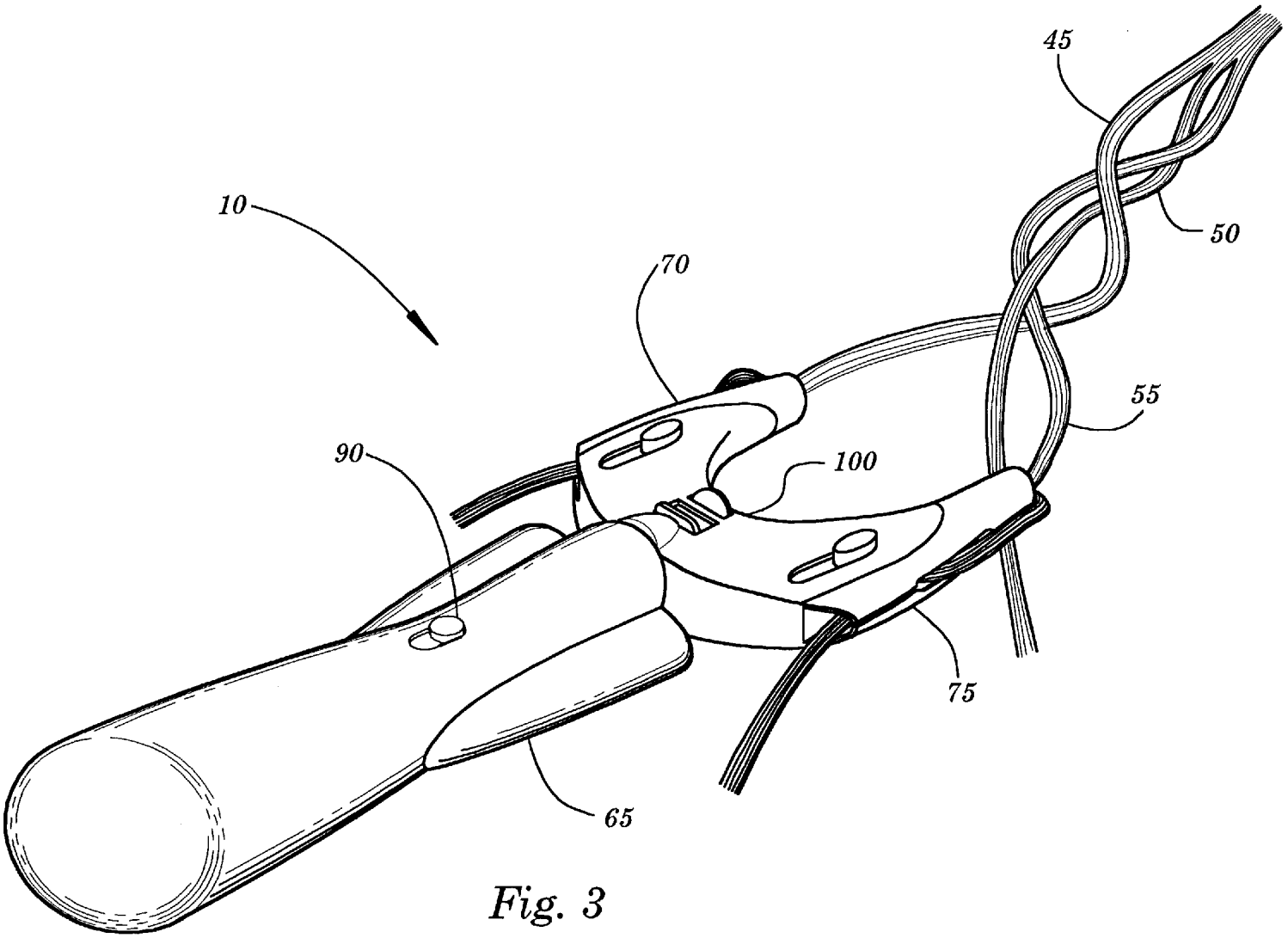
FIG. 3 shows the preferred embodiment in perspective, positioned in the third stage of a braiding cycle.

FIGS. 1 through 3 show the preferred embodiment of the invention in a braiding cycle. The braiding process will be described first, and then the mechanical structure which facilitates the braiding.

Figure 4:
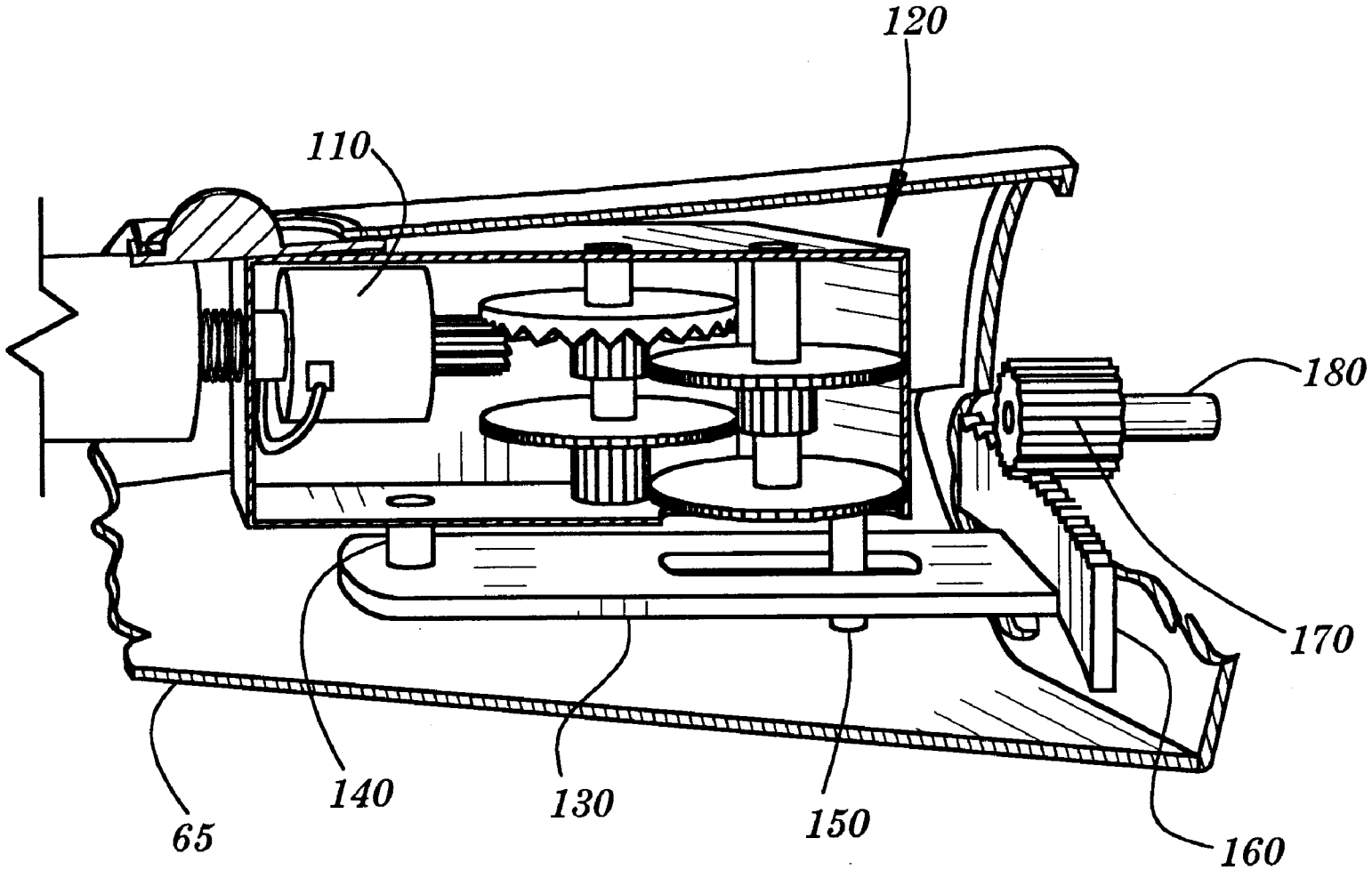
FIG. 4 is a cut-away perspective view of the handle of the preferred embodiment, showing the means for cyclically reversing the arms of the apparatus.

First, the hair to be braided is separated into three strands, 45, 50, and 55. Strand 45 is to the left of the person braiding, strand 55 is to the right of the person braiding, and middle strand 50 is disposed between strands 45 and 55. Strand 45 is threaded through the left hook 85 in the left arm 20 of the braiding apparatus, and strand 55 is threaded through the right hook 80 in the right arm 25 of the braiding apparatus 10. The hooks 80 and 85, shown in FIG. 4, are retracted into the arms 20 and 25 thereby holding the strands 45 and 55 in slideable engagement with respect to the arms 20 and 25.

The strands 45 and 55 are pulled through the left and right arms 20 and 25 until about 2.5 cm (1 inch) of hair is available between the arms 20 and 25 and the head of the person whose hair is to be braided. A means is provided to automatically cyclically reverse the position of the arms 20 and 25, which means is described in more detail below.

When the operator turns the switch 90 to its on position and energizes the mechanism, the arms 20 and 25 are caused to cyclically rotate 180 degrees as shown in FIG. 2, so that the arms 20 and 25 exchange positions relative to the operator, carrying and crossing the strands 45 and 55 with them, as shown in FIG. 2. The middle strand 50 is then grasped by the operator and pulled upward through the opening defined by the arms 20 and 25 and strands 45 and 50, to cross strand 55, as shown in FIG. 2.

The middle strand 50 is next held downward by the operator across strand 55, as the arms 20 and 25 automatically rotate in the opposite sense to the rotation just described, as shown in FIG. 3. This forms the first crossing of the braid.

The braiding apparatus 10 and the strands 45, 50 and 55 are now in the same relative positions as at the beginning of this detailed description, ready for another cycle of braiding, which begins automatically. As braid advances, the operator allows the strands 45 and 55 to slide through the hooks 80 and 85, while keeping tension on the advancing braid.

The tightness of the braid is increased by holding the middle strand 50 firmly and increasing the tension of the left and right strands 45 and 55. The braid is made looser by holding the middle strand 50 loosely and decreasing the tension of the left and right strands 45 and 55. The tension may be modulated by the operator by pulling the braiding apparatus 10 more or less firmly away from the subject's head, or by causing the hooks 80 and 85 to slightly retract and extend, as explained later.

In the preferred embodiment, hair guides 70 and 75 are attached to the arms 20 and 25, respectively. The hair guides 70 and 75 are not necessary to the functioning of the preferred embodiment, but they aid in controlling the braiding process, when the hair strands 45 and 55 are passed through them. The hair guides 70 and 75 are preferably made of a resilient material, such as rubber or soft plastic, so that the hair strand may be pushed into them through a slit 72 in each hair guide 70 and 75, and held in the guide as the slit 72 resiliently closes.

FIG. 4 shows the internal mechanism of the braiding apparatus 10 in the preferred embodiment, and illustrates the means employed in that embodiment for automatically cyclically reversing the position of the left and right arms 80 and 85. A motor 110 and a speed reducing transmission 120 are enclosed within a handle 65, suitable for grasping by the hand of a human operator. The speed reducing transmission shown in FIG. 4 is illustrative only, and other such transmissions having different gearing systems known in the art could be used to reduce the speed of the motor output. The motor 110 may be a battery-powered DC motor, for example, and the batteries may be of the rechargeable type. Another embodiment could use an AC powered motor. A conventional motor speed control could be used to allow the user to adjust the speed of the alternate reversals of the arms 20 and 25. Cyclic rotary motion of the arms 20 and 25 is achieved in the preferred embodiment by a means for converting continuous rotary motion from the motor to cyclic rotary motion. In the preferred embodiment, this means functions as follows: The output of the speed reducing transmission 120 has an eccentrically rotating first pin 150 which engages a link 130, which link 130 is moveably fixed at its first end by a pivot 140. The link 130 is thus caused to oscillate back and forth when the motor 110 is energized. The link 130 supports a rack 160 at its second end, which rack 160 engages a pinion 170. The pinion 170 is connected to the left arm 20 and right arm 25; for example, by a shaft 180 which is engaged by a socket 260 in the case 100 defining the arms 20 and 25. Alternately, the pinion may be connected to a socket and a shaft connected to the case 100. Such shafts and sockets may be friction fit, keyed, or held by spring actuated ball and detent mechanisms, or in other conventional ways. The oscillatory motion of the rack 160 rotates the pinion 170 alternately in one direction, and then the other, thus causing the arms 20 and 25, to reverse positions cyclically. In the preferred embodiment the arms 20 and 25 rotate approximately 180 degrees before reversing their rotation. Other embodiments could use different mechanical means to create cyclic rotary motion, such as cranks and cams.

As further shown in FIGS. 5 through 8, the arms 20 and 25 receive left and right hooks 80 and 85, respectively. These hooks 80 and 85 engage the left and right strands of hair 45 and 55, as described above, when the hooks 80 and 85 are retracted into the arms 20 and 25 and hold the strands 45 and 55 in slideable engagement.

Figure 5:
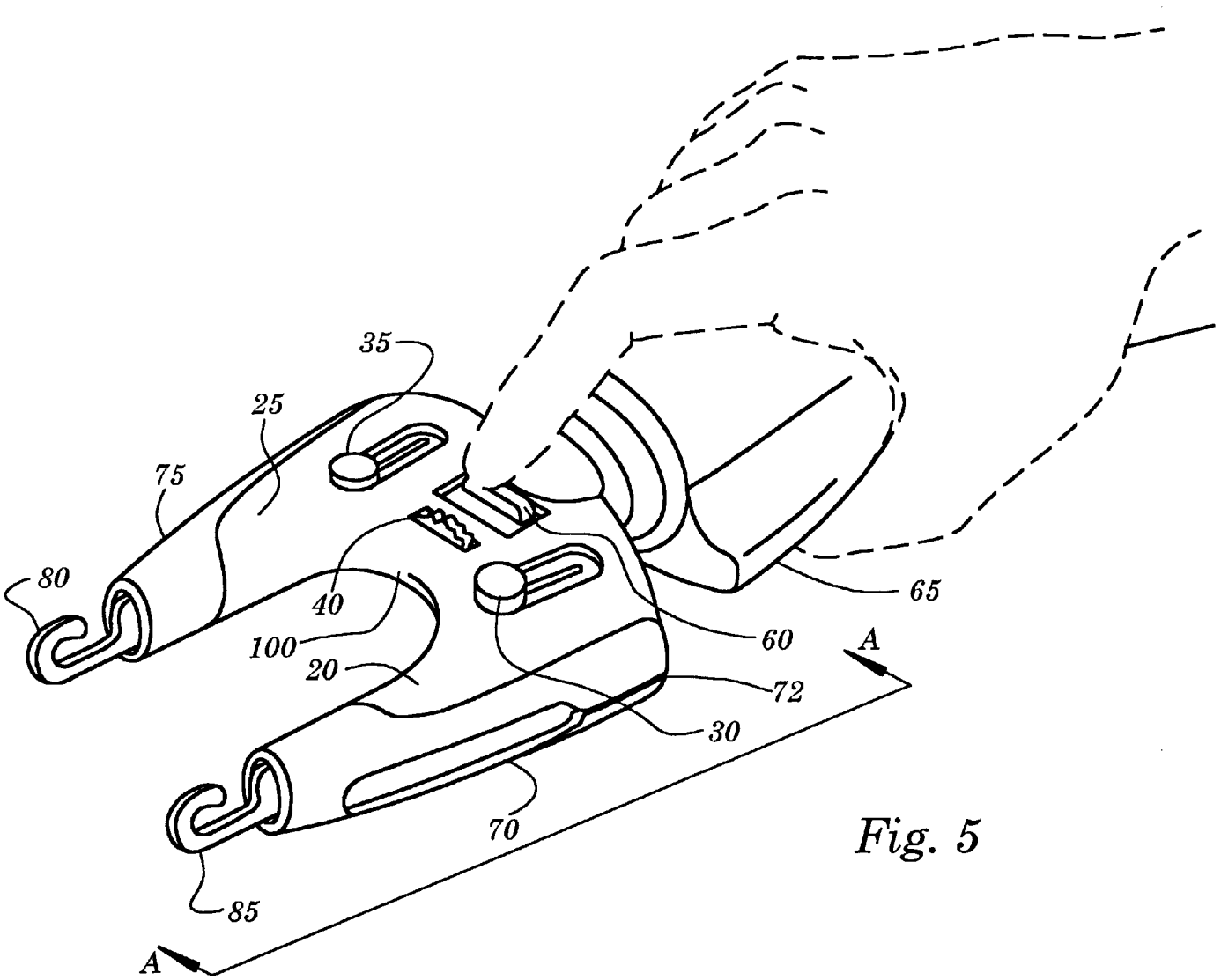
FIG. 5 is a perspective view of the arms of the preferred embodiment, showing the arms of the apparatus with the hooks extended.
Figure 6:
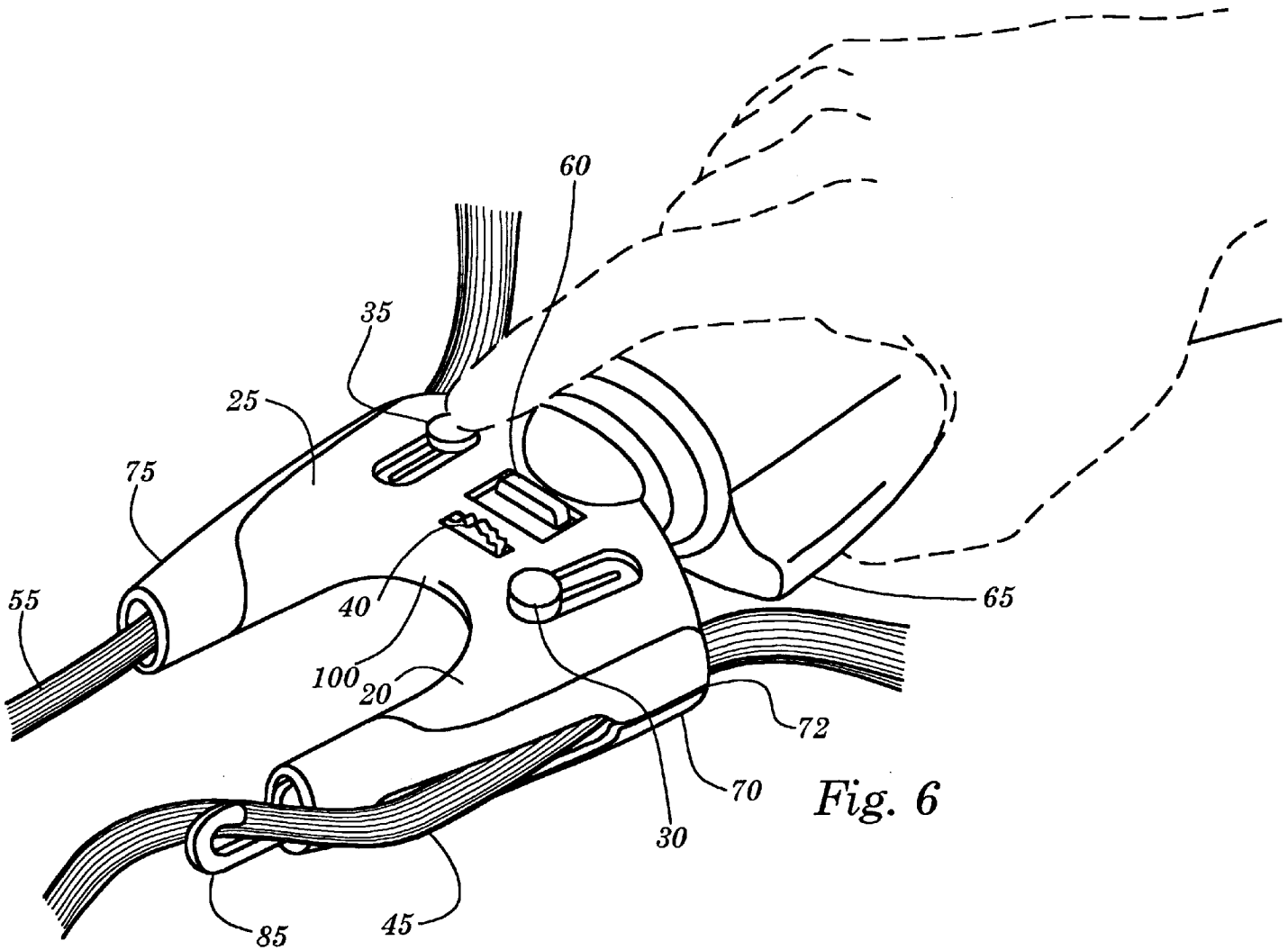
FIG. 6 is a perspective view of the arms of the preferred embodiment, showing the arms of the apparatus with the one hook extended to grasp a strand of hair.

As shown in FIGS. 5, 6, and 7, the preferred embodiment has slideably operated means 30 and 35 for retracting the hooks 80 and 85. FIGS. 8 and 9 show the internal means by which the slideably operated means 30 and 35 act to retract or extend each hook. FIG. 8 is a cross-sectional view of the arms 20 and 25 of the preferred embodiment, showing the internal means by which the hooks 80 and 85 are extended, retracted, locked in place, and released.

FIG. 8 shows for each hook 80 and 85, a spring 210 associated with the hook 80 and 85. These springs 210 rest against the case 100 forming the arms 20 and 25 and press against the hooks 80 and 85, urging them outward from the arms 20 and 25. Each hook 80 and 85 has at its proximal end, a detent 220. This detent 220 engages a latch 230, which is mounted in an adjustable carriage 250. Each latch 230 is urged against the detent 220 by a latch spring 240, on either side of the carriage 250. The carriage 250 and its associated parts are shown in more detail in FIG. 9. A screw 200 passes through the carriage 250, and engages threads on the carriage 250. The position of the carriage 250 relative to the hook detents 220 may thus be adjusted by means of the thumb wheel 40 moved by the operator. The hooks 80 and 85 are extended and retracted by a slideably operated means 30 and 35, attached to the proximal end of each hook. In the preferred embodiment, the slideably operated means 30 and 35 are sliding buttons engaging the proximal end of the hooks inside the case 100. This mechanism allows the tension on the hair strands to be set differently, since the detents 220 and the latches 230 in the preferred embodiment operate independently of one another. By rotating the thumb wheel 40, the operator may finely adjust the position of the hooks when the detents 220 are engaged by the latches 230 in the carriage 250, thus allowing greater or lesser tension to be applied to the hair strands being braided.

The preferred embodiment further has a hook-release means 60, which in the preferred embodiment is a button contacting the latches 230. When the operator presses downward on the hook-release means, the hooks 80 and 85 are released as the latches 230 disengage from the detents 220 and are urged to extend from the arms by the springs 210. Any hair strands then grasped are released. Since the each latch 230 and its corresponding latch spring 240 in the preferred embodiment may move independently of one another, either of the hooks 80 and 85 may be released independently of the other, or both may be released together. In an alternate embodiment of the invention, both hooks 80 and 85 may be held retracted by one latch 230 contacting both detents 220. The hook-release means 60 then causes both latches 230 to disengage from both detents 220, when the hook-release means 60 is actuated by the operator.

The reader will see that the operator may rapidly engage typical hair strands 45, 50 and 55, braid them as the arms 20 and 25 of the braider 10 rotate cyclically, and release them easily when a braid is complete. Since all controls for the braiding process are on the braider 10 itself, the operator's other hand is left free to manipulate the hair strands 45, 50, and 55, as described above.

FIGS. 10 and 11 show another embodiment of the invention. In this embodiment, only one strand of hair 336 from the subject is braided into a single strand 335 which extends from left and right reels 360 and 365. The reels are mounted in a case 450 defining left and right arms 320 and 325. The single strand 335 plays out from the reels 360 and 365 through the arms 320 and 325, preferably across guide rollers 350 and 355 in the distal portion of the arms 320 and 325.

FIG. 10 shows a cross-section detail of a typical reel 360 or 365. In the preferred version of this embodiment, the reels 360 and 365 are held in place by an axle 380 defined by depressions formed in the case 450. Corresponding depressions 410 are formed in the reels 360 and 365, which allow the reels 360 and 365 to turn. Alternate means for rotatably mounting the reels 360 and 365 could be used, such as pins passing through the center of the reels 360 and 365, or conventional forms of bearings. The tension of the single strand 335 may be varied in this embodiment by an adjustment screw 370, passing through the case 450. This screw 370 may be tightened or loosened by the operator to press the sides of the case 450, and thus the depressions in the case 410 are pressed into the axles 380 of the reels 360 and 365, frictionally restraining their movement.

Each reel 360 and 365 has a circumferential groove 420 for receiving a strand of natural or artificial hair 335. The single strand 335 plays out and is formed into a braid as the arms 320 and 325 alternately reverse position, essentially as described above for the first embodiment of the invention. The means for automatically cyclically reversing the positions of the left and right arms can be the same as that described for the first embodiment above.

The need for a mechanically simple yet mechanized hair braiding apparatus has been attained by the present invention, as described above. Since certain changes could be made in the embodiment of the invention described above without departing from the spirit and scope of the invention, we intend that all matter contained in the foregoing description and drawings shall be interpreted as illustrative and not in a limiting sense. The reader should understand that the following claims are intended to cover all of the generic and specific features of the invention herein described and all statements of the scope of the invention which might be interpreted to fall between these features.

We claim:

1. An apparatus for braiding hair comprising:

a. a left arm; the left arm having a left hook for grasping a first strand of hair;

b. a right arm; the right arm having a right hook for grasping a second strand of hair;

c. a slidably operated means for retracting and extending the left and right hooks with respect to the left and right aims, so that the left and right hooks hold the first and second strands of hair respectively, in slideable engagement; and, d. a means for automatically cyclically reversing the positions of the left and right arms, so that the first strand, the second strand, and a third strand of hair may be braided together by alternate reversal of the positions of the left and right arms while the third strand is alternately pulled upward and downward by the operator.

2. The apparatus of claim 1 above further comprising a slidably operated means attached to the proximal end of each hook for retracting and extending the left and right hooks.

3. The apparatus of claim 2 above further comprising springs engaging the proximal end of each hook and urging the hooks to extend from the arms.

4. The apparatus of claim 1 where the means for retracting and extending the left and right hooks comprises:

a. the left and right hooks each having a detent in its proximal end;

b. an adjustable carriage; the carriage further comprising a latch;

b. the latch selectively engaging the detent, thereby locking the hooks in a selected retracted position; and, c. a spring engaging the proximal end of each hook and urging the hooks to extend from the arms.

5. The apparatus of claim 4 further comprising a means for releasing the hooks from a retracted position.

6. The apparatus of claim 5 where the means for releasing the hooks from a retracted position comprises a button contacting the latch, so as to selectively disengage the latches when the button is pressed.

7. The apparatus of claim 4 further comprising a screw passing through and threadably engaging the carriage, whereby the position of the carriage may be adjusted by turning the screw.

8. The apparatus of claim 1 where the means for retracting and extending the left and right hooks comprises:

a. the left and right hooks each having a detent in its proximal end;

b. an adjustable carriage; the carriage further comprising two latches;

c. each of the latches selectively engaging a corresponding detent, thereby selectively locking either or both of the hooks in a selected retracted position; and, d. a spring engaging the proximal end of each hook and urging the hooks to extend from the arms.

9. The apparatus of claim 8 further comprising a means for releasing the hooks from a retracted position.

10. The apparatus of claim 9 where the means for releasing the hooks from a retracted position comprises a button contacting the latches, so as to selectively disengage one or both of the latches when the button is pressed.

11. The apparatus of claim 8 further comprising a screw passing through and threadably engaging the carriage, whereby the position of the carriage may be adjusted by turning the screw.

12. The apparatus of claim 1 where the means for automatically cyclically reversing the position of the left and right arms comprises a means for converting continuous rotary motion to cyclic rotary motion.

13. The apparatus of claim 12 where the means for automatically cyclically reversing the position of the left and right arms further comprises a motor.

14. The apparatus of claim 12 where the means for automatically cyclically reversing the position of the left and right arms further comprises a speed-reducing transmission connected to the motor.

15. The apparatus of claim 13 where the motor is a battery-powered DC motor.

16. The apparatus of claim 12 where the means for converting continuous rotary motion to cyclic rotary motion further comprises:

a. an eccentrically rotating first pin;

b. a link having a first end and a second end; the link fixed moveably at its first end by a pivot;

c. a rack connected to the second end of the link; the rack engaging a pinion;

d. the pinion connected to the left and right arms, so that the left and right arms cyclically rotate and alternately reverse their positions as the pinion is turned by the rack.

17. The apparatus of claim 1 where the left and right arms each have a hair guide.

18. An apparatus for braiding hair comprising:

a. a left arm; the left arm having a left hook for grasping a first strand of hair; the left hook having a detent in its proximal end;

b. a right arm; the right arm receiving a right hook for grasping a second strand of hair; the right hook having a detent in its proximal end;

c. the left and right arms each having a hair guide;

d. a means for retracting and extending the left and right hooks with respect to the left and right arms, so that the left and right hooks hold the first and second strands of hair respectively, in slideable engagement, comprising:

i. a slidably operated means attached to the proximal end of each hook;

ii. a spring engaging the proximal end of each hook and urging the hooks to extend from the arms;

iii. an adjustable carriage, the carriage further comprising two latches; each latch selectively engaging a corresponding detent, thereby selectively locking either or both of the hooks in a selected retracted position;

iv. a screw passing through and threadably engaging the carriage, whereby the position of the carriage may be adjusted by turning the screw;

v. a means for releasing the hooks from a retracted position comprising a button contacting each latch, so as to selectively disengage one or both latches when the button is pressed;

e. means for automatically cyclically reversing the positions of the left and right arms, so that the first strand, the second strand, and a third strand of hair may be braided together by alternate reversal of the positions of the left and right arms while the third strand is alternately pulled upward and downward by the operator, comprising:

i. a battery-powered DC motor connected to a speed-reducing transmission;

ii. the speed-reducing transmission connected to a means for converting continuous rotary motion from the motor to cyclic rotary motion, comprising:

(1) an eccentrically rotating first pin;

(2) a link having a first end and a second end; the link fixed moveably at its first end by a pivot;

(3) a rack connected to the second end of the link; the rack engaging a pinion;

(4) the pinion connected to the left and right arms, so that the left and right arms rotate and cyclically reverse their positions as the pinion is turned by the rack.

19. An apparatus for braiding hair comprising:

a. a left arm;

b. a right arm;

c. left and right reels holding a single strand of hair, the strand of hair passing out of the left and right arms respectively for braiding into a second strand of hair;

d. a means for automatically cyclically reversing the positions of the left and right arms, so that the single strand, and the second strand, may be braided together by alternate reversal of the positions of the left and right arms while the second strand is alternately pulled upward and downward by the operator.

* * * * *